United States Patent [19]

Barbe

[11] 4,115,085

[45] Sep. 19, 1978

[54] APPARATUS FOR EXPELLING GASES FROM LIQUID ADHESIVES

[75] Inventor: Karl-Heinz Barbe, Hamburg, Fed. Rep. of Germany

[73] Assignee: Hauni-Werke Körber & Co. Kg., Fed. Rep. of Germany

[21] Appl. No.: 804,336

[22] Filed: Jun. 7, 1977

[30] Foreign Application Priority Data

Jul. 31, 1976 [DE] Fed. Rep. of Germany ..... 2634548

[51] Int. Cl.[2] ..... B01D 19/00

[52] U.S. Cl. ..... 55/193; 55/206; 118/603; 118/610

[58] Field of Search ..... 55/36, 51, 52, 55, 159, 55/189, 190, 199, 207, 193; 118/600, 602, 603, 610

*Primary Examiner*—Frank A. Spear, Jr.
*Assistant Examiner*—Richard W. Burks
*Attorney, Agent, or Firm*—Peter K. Kontler

[57] ABSTRACT

Apparatus for expelling gas bubbles from liquid adhesive which is conveyed through a conduit connecting an adhesive-containing vessel with a nozzle which applies adhesive to the running web of wrapping material in a tobacco or filter material processing machine. The conduit has a first section which contains a large-capacity pump and discharges adhesive into the enlarged portion of an annular channel defined by the cylinder and core of a gas evacuating device. The enlarged portion is followed by a second portion of smaller cross-sectional area which communicates with a radially inwardly extending gap of the core to admit some adhesive and the gases into a passage serving to return the gases and escaping adhesive to the vessel. A second section of the conduit contains a smaller-capacity pump and serves to feed degasified adhesive from the second portion of the channel to the nozzle.

10 Claims, 1 Drawing Figure

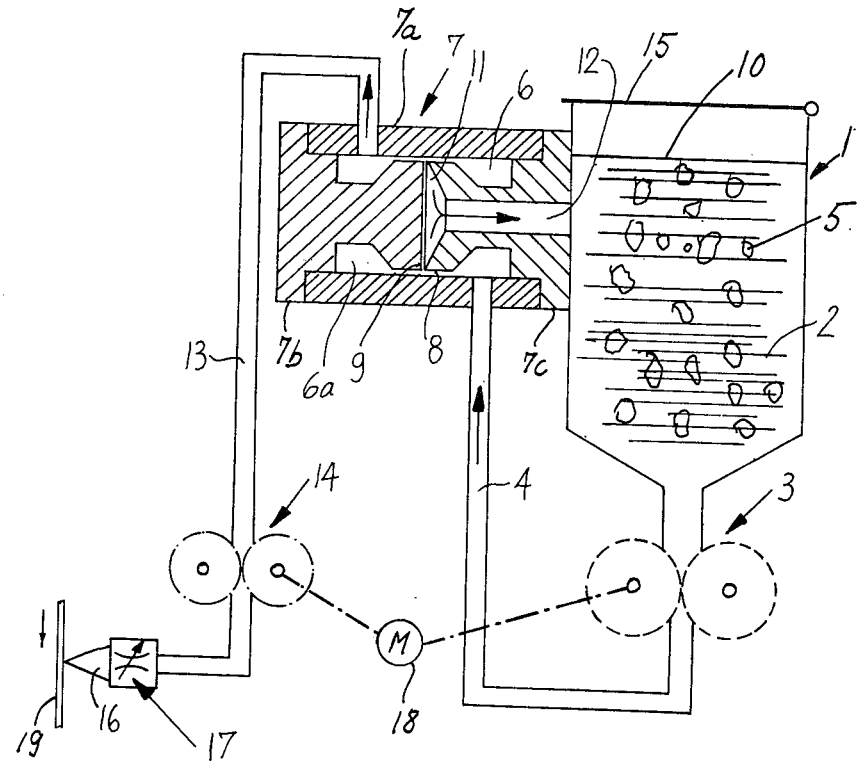
7a
7
11
6
12
15
10
1
5
2
13
7b
6a
9
8
7c
14
4
3
M
18
19
16
17

APPARATUS FOR EXPELLING GASES FROM LIQUID ADHESIVES

BACKGROUND OF THE INVENTION

The present invention relates to apparatus for feeding liquid adhesive to one or more consuming stations, and more particularly to improvements in apparatus which are especially suited to supply adhesive to the applicators of machines for the production and/or processing of smokers' products including plain or filter tipped cigarettes, cigarillos or cigars, cheroots, filter rod sections, and packs for cigarettes or the like. Still more particularly, the invention relates to improvements in apparatus for expelling entrapped air and/or other gases from a stream of adhesive which is caused to flow from a source of supply to one or more applicators.

Cigarette making machines, filter rod making machines and other types of machines for the production and/or processing of smokers' products employ so-called pasters which serve to apply films of adhesive to running webs of flexible sheet material, such as cigarette paper, imitation cork, reconstituted tobacco, strips of paper or lightweight cardboard which are to be converted into components of packs for smokers' products and the like. Conventional pasters employ wheel-shaped applicators whose peripheral surface receives a film of paste and rolls along the running web which is to be coated with adhesive, either in its entirety, along one or both marginal portions, along one or more intermediate portions, or along one or more marginal portions as well as along one or more intermediate portions. Such applicators are satisfactory as long as the speed of the web does not exceed a certain value. Therefore, many recent types of high-speed machines in the tobacco processing field, especially cigarette makers and filter rod makers, employ applicators in the form of nozzles which can discharge directed streams of liquid adhesive to one or more selected portions of a running web. The adhesive which is used in such machines is often highly viscous and is likely to contain entrapped bubbles of air or another gas. The presence of such bubbles in the stream of adhesive issuing from a nozzle is highly undesirable because the bubbles interrupt the films of adhesive which are applied to the running web. If the web consists of cigarette paper and is used for conversion into the tubular envelope of a cigarette rod, the absence of adhesive caused by gas bubbles results in weakening of the corresponding portions of the seam where the marginal portions of the tubular envelope of a cigarette rod overlap. Since the filler of a cigarette rod contains compacted tobacco, the weakened portion of the seam is likely to open, i.e., the wrapper of the respective cigarette develops a leak which is detected by the testing unit or units and the corresponding article is segregated from acceptable articles with resulting losses in output and tobacco. Thus, the presence of air bubbles in the stream of adhesive which is supplied to the applicator of a cigarette making or like machine presents serious problems which are not adequately solved by presently known degasifying apparatus or are solved, to a certain extent, by utilizing highly complex degasifying and/or adhesive preparing and processing equipment.

OBJECTS AND SUMMARY OF THE INVENTION

An object of the invention is to provide an apparatus which can segregate entrapped gases from adhesive in a simple and inexpensive way.

Another object of the invention is to provide an apparatus which is constructed and assembled in such a way that it invariably expels or removes entrapped gas bubbles whose size is sufficiently large to cause the production of a defective smokers' product in a cigarette maker, a filter rod maker or an analogous machine.

A further object of the invention is to provide an apparatus which can be installed in existing machines for the manufacture and/or processing of smokers' products as a superior substitute for conventional apparatus.

An additional object of the invention is to provide the apparatus with novel and improved means for devolatilizing a continuous stream of adhesive.

Another object of the invention is to provide an apparatus which can be used for expulsion or evacuation of entrapped gases from highly viscous or readily flowable liquid adhesives, for example, from hotmelts or so-called wet adhesives.

An ancillary object of the invention is to provide the apparatus with novel and improved means for recovering adhesive which escapes with segregated gases.

The invention is embodied in an apparatus for expelling gases (e.g., air) from a liquid adhesive which is supplied to the nozzle or another suitable applicator of a machine which produces and/or processes smokers' products and wherein the adhesive is applied to a running web of wrapping material (e.g., cigarette paper, artificial cork or the like). The apparatus comprises a vessel which stores a supply of gas-containing adhesive, conduit means connecting the vessel with the applicator, a gas removing device which is installed in the conduit means and includes an annular channel preferably having a first portion of larger cross-sectional area which receives adhesive from the vessel and a flow restricting second portion of smaller cross-sectional area which receives adhesive from the first portion, a preferably circumferentially complete annular gap provided in the gas removing device and communicating with the second portion of the channel to receive gases and some adhesive, and means for conveying the adhesive from the vessel, through the gas removing device and to the applicator. The conveying means includes means (e.g., a larger-capacity gear pump in the conduit means between the vessel and the gas removing device and a smaller-capacity gear pump in the conduit means between the gas removing device and the applicator) for maintaining the adhesive at a higher pressure upstream and at a lower pressure downstream of the gas removing device.

The gas removing device is preferably provided with a passage which connects the gap with the interior of the vessel so that adhesive which escapes from the channel by way of the gap and the gases which follow the same route can be returned into the vessel, preferably in a region immediately below the upper level of the supply of adhesive in the vessel. The diameter of the passage preferably exceeds the width of the gap so that the gases which enter the passage can expand on their way back into the vessel.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWINGS

The single FIGURE is a schematic partly elevational and partly vertical sectional view of an apparatus which embodies one form of the invention and is used to supply adhesive to a nozzle-like applicator in a tobacco or filter material processing machine.

DESCRIPTION OF THE PREFERRED EMBODIMENTS

The drawing shows an apparatus which serves to supply a continuous stream of liquid adhesive to the orifice of a nozzle-like applicator 16 forming part of a machine for the making and/or processing of smokers' products, for example, of a cigarette maker known as "GARANT" (trademark) which is manufactured by Hauni-Werke Korber & Co. KG, of Hamburg, Federal Republic Germany.

The apparatus comprises a vessel or tank 1 for a supply of liquid adhesive 2 containing entrapped bubbles 5 of gas, such as air. The outlet at the lower end of the vessel 1 is connected with the applicator 16 by a conduit having a first section 4 which receives adhesive directly from the vessel and contains a large-capacity gear pump 3, and a second section 13 which feeds degasified or evolatilized adhesive to the applicator 16. The latter may but need not be provided with an adjustable flow restrictor 17. The section 13 contains a smaller-capacity gear pump 14.

The sections 4 and 13 of the conduit are connected to each other by a gas removing device 7 which is constructed and assembled in accordance with a feature of the invention. This device compdrises a housing or cylinder *7a* and a core including two mirror symmetrical portions *7b, 7c*. The portion *7b* of the core seals the left-hand end of the cylinder *7a* and its right-hand end face is spaced apart from the left-hand end face of the portion *7c* so that these portions define a circumferentially complete narrow annular clearance or gap 9. The cylinder *7a* and the portions *7b, 7c* of the core define an elongated annular channel having a first or upstream portion 6, a flow restricting median portion 8 and a downstream portion *6a*. The cross-sectional areas of the portions 6 and *6a* greatly exceed the cross-sectional area of the flow restricting portion 8, and the latter communicates with the gap 9. The conduit section 4 feeds gas-containing adhesive into the portion 6 and the conduit section 13 receives devolatilized adhesive from the portion 8 via portion *6a* of the channel. The portion *7c* of the core is formed with an axial passage including a larger portion 11 which is in direct communication with the gap 9 and a smaller-diameter portion 12 which allows adhesive and gases to flow back into the vessel 1. The outlet of the passage is located below the upper level 10 of the supply of adhesive in the vessel 1. This vessel has a pivotable cover or lid 15. The means for supplying gas-containing adhesive to the vessel 1 at a rate which is needed to insure that the level 10 remains constant or fluctuates within a rather narrow range is not shown in the drawing.

The operation is as follows:

The gear pump 3 draws a continuous stream of adhesive from the bottom zone of the interior of the vessel 1 and pressurizes the withdrawn adhesive while the adhesive flows in the conduit section 4 toward and into the portion 6 of the channel in the device 7. The leader of the adhesive stream is caused to flow through the median portion 8 of the channel whereby the entrapped gases, together with relatively small quantities of adhesive, flow radially inwardly through the gap 9 and into the enlarged portion 11 of the passage in the core portion *7c* on their way back into the vessel 1. The uppermost stratum of the supply of adhesive in the vessel 1 seals the outlet of the passage in the core portion *7c* from the atmosphere. This insures that atmospheric air cannot penetrate into the gap 9 and thence into the conduit section 13 when the apparatus is idle, i.e., when the pumps 3 and 14 are not driven. If the upper level of the supply of adhesive in the vessel 1 fluctuates within a wide range, the outlet of the passage 11, 12 is preferably placed close to the bottom wall of the vessel.

The quantity of adhesive which returns into the vessel 1 via gap 9 and passage 11, 12 is relatively small. The major part of adhesive flows through the channel portion *6a* and into the conduit section 13, i.e., toward the intake of the pump 14 which feeds devolatilized adhesive to the nozzle 16.

The gear pumps 3 and 14 are preferably driven by a common prime mover 18 at identical speeds. Since the capacity of the pump 3 exceeds the capacity of the pump 14, the pressure of adhesive in the conduit section 4 is higher than the pressure in the conduit section 13. When the viscosity of adhesive is relatively low (e.g., when the adhesive has a consistency resembling that of honey), the ratio of the capacities of pumps 3 and 14 can be selected in such a way that the pressure of adhesive in the section 4 is three times the pressure of adhesive in the section 13 of the composite conduit. If the viscosity of the adhesive is relatively high (e.g., if the adhesive is a rather thick paste), the pressure differential will be much higher. Many types of wet adhesives (e.g., those which contain starch) are often fed to the consuming machine in a highly viscous state. Furthermore, if the viscosity of adhesive in the vessel 1 is high or very high, the lid 15 is preferably replaced with a cover which seals the upper end of the vessel from the surrounding atmosphere, and the upper portion of the interior of the vessel (above the level 10) is connected with a source of compressed gas to enhance the flow of adhesive into the conduit section 4. As a rule, the application of a relatively low pressure to the upper surface of the supply of adhesive in the vessel 1 suffices to insure a continuous flow to the intake of the pump 3, even if the viscosity of the adhesive is very high. A paster with a plenum chamber above the supply of adhesive in the vessel is disclosed in the commonly owned German Pat. No. 2,452,138.

The width of the gap 9 (whose plane is normal to the axis of the channel 6, 8, *6a*) is exaggerated in the drawing for the sake of clarity. Such width depends on the size of bubbles which are to be destroyed and their contents removed from the adhesive flowing toward and into the conduit section 13. If the viscosity of adhesive is relatively low (e.g., if the consistency of adhesive is that of honey), the width of the portion 8 of the channel (as considered in the radial direction of the cylinder *7a*) may equal or approximate 0.5 mm and the width of the gap 9 (as considered in the axial direction of the cylinder *7a*) may equal or approximagte 0.03 mm. This means that gases are invariably liberated from all bubbles whose diameter exceeds 0.5 mm. Smaller bubbles will be eliminated by reducing the width of the channel portion 8 accordingly. As a rule, the elimination of bubbles with a diameter larger than 0.5 mm suffices to insure the formation of a practically continuous adhesive film on the web 19 which is transported past the orifice of the nozzle 16.

If desired, the liberated gases can be evacuated from the flow restricting portion 8 of the channel between the cylinder and core of the device 7 flowing radially outwardly from the portion 8. However, the illustrated constructon is preferred at this time because it insures that adhesive which excapes with liberated gases is returned to the vessel 1 along the shortest path.

An important advantage of the improved apparatus is that it can remove gases from adhesives whose viscosity may vary within an extremely wide range, and also that the apparatus can employ a very simple, compact and inexpensive gas removing device. Moreover, the apparatus can be readily adjusted to eliminate only large, large and medium sized or large, medium sized and small gas bubbles. All that is necessary is to replace the core *7b, 7c* with a differently dimensioned core or to furnish the apparatus with two, three or more interchangeable gas removing devices. Furthermore, the apparatus can be used to supply adhesive which need not be subjected to any devolatilizing treatment prior to admission into the vessel 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Apparatus for expelling gases from a liquid adhesive supplied to the applicator of a machine which produces and/or processes smokers' products and wherein the adhesive is applied to a running web of wrapping material or the like, comprising a vessel arranged to store a supply of gas-containing adhesive; conduit means connecting said vessel with said applicator; a gas removing device installed in said conduit means and including an annular channel having a flow restricting portion, said device further having a gas-evacuating gap communicating with said portion of said channel; and means for conveying adhesive in said conduit means from said vessel, through said channel and to said applicator, including means for maintaining the adhesive at a higher pressure upstream and at a lower pressure downstream of said device.

2. Apparatus as defined in claim 1, wherein said gap is an annular gap and extends inwardly from said portion of said channel.

3. Apparatus as defined in claim 1, wherein said gap is an annular gap disposed in a plane which is substantially normal to the axis of said channel.

4. Apparatus as defined in claim 1, wherein said device further includes a passage connecting said gap with said vessel so that adhesive and gases entering said gap can flow back into said vessel.

5. Apparatus as defined in claim 4, wherein the diameter of said passage exceeds the width of said gap.

6. Apparatus as defined in claim 4, wherein the supply of adhesive fills said vessel to a predetermined level and said passage communicates with said vessel immediately below such level.

7. Apparatus as defined in claim 1, wherein said means for maintaining the adhesive at a higher pressure upstream and at a lower pressure downstream of said device while expelling gas through said gap comprises a larger-capacity first pump installed in said conduit means upstream of said device and a smaller-capacity pump installed in said conduit means downstream of said device.

8. Apparatus as defined in claim 1, wherein said channel includes a first portion of larger cross-sectional area, a second portion of smaller cross-sectional area which constitutes said flow restricting portion and is located downstream of said first portion, and a third portion located downstream of said second portion and having a cross-sectional area exceeding the cross-sectional area of said second portion.

9. Apparatus as defined in claim 8, wherein said device comprises a tubular housing and a core located in said housing and defining therewith said channel, said conduit means including a first section which admits adhesive to said first portion and a second section which receives adhesive from said third portion of said channel.

10. Apparatus as defined in claim 9, wherein said gap is provided in said core and said core has a passage which connects said gap with the interior of said vessel.

* * * * *